US009566694B2

(12) United States Patent
Lacert

(10) Patent No.: US 9,566,694 B2
(45) Date of Patent: Feb. 14, 2017

(54) OPEN ENDED SOCKET WRENCH

(71) Applicant: Marlon Elwin Lacert, Choiceland (CA)

(72) Inventor: Marlon Elwin Lacert, Choiceland (CA)

( * ) Notice: Subject to any disclaimer, the term of this patent is extended or adjusted under 35 U.S.C. 154(b) by 350 days.

(21) Appl. No.: 14/312,932

(22) Filed: Jun. 24, 2014

(65) Prior Publication Data

US 2014/0373685 A1 Dec. 25, 2014

Related U.S. Application Data

(60) Provisional application No. 61/838,429, filed on Jun. 24, 2013.

(51) Int. Cl.

| | |
|---|---|
| ***B25B 13/58*** | (2006.01) |
| ***B25B 13/08*** | (2006.01) |
| ***B25B 13/46*** | (2006.01) |

(52) U.S. Cl.

CPC ..... *B25B 13/58* (2013.01); *B25B 13/08* (2013.01); *B25B 13/46* (2013.01)

(58) Field of Classification Search

CPC ..... B25B 13/08; B25B 13/46; B25B 13/58

See application file for complete search history.

(56) References Cited

U.S. PATENT DOCUMENTS

| | | | | |
|---|---|---|---|---|
| 3,695,125 | A | | 10/1972 | Glass et al. |
| 4,204,440 | A | | 5/1980 | Del Prete et al. |
| 4,441,387 | A | | 4/1984 | Hendricks |
| 4,562,757 | A | | 1/1986 | Furey |
| 4,604,919 | A | | 8/1986 | Rollo |
| 4,718,315 | A | * | 1/1988 | Nitschmann ..... B25B 13/46 81/117 |
| 5,249,487 | A | | 10/1993 | Armfield, IV |
| 5,287,777 | A | | 2/1994 | Kolodziej |
| 5,454,283 | A | | 10/1995 | Stefano |
| 5,456,143 | A | * | 10/1995 | Stanton ..... B25B 13/46 81/179 |
| 5,533,428 | A | | 7/1996 | Pradelski |
| 5,553,520 | A | | 9/1996 | Jacobs |
| 5,582,083 | A | | 12/1996 | Baker |
| 6,158,309 | A | | 12/2000 | Baker |
| 7,024,971 | B2 | | 4/2006 | Stanton |
| 7,188,550 | B2 | | 3/2007 | Tsai |
| 7,249,539 | B2 | | 7/2007 | Dicaprio |
| 2007/0044593 | A1 | | 3/2007 | Murdoch, Sr. |
| 2011/0209583 | A1 | | 9/2011 | Hsieh |

* cited by examiner

*Primary Examiner* — Robert Scruggs

(74) *Attorney, Agent, or Firm* — Kyle R. Satterthwaite; Ryan W. Dupuis; Ade & Company Inc.

(57) ABSTRACT

A head of an open ended ratchet features outer face plates with voids that delimit a jaw space that is open at one end. Two gripping pieces face toward one another from opposing sides of the jaw space. A working side of each gripping piece features two working faces that lie at an oblique angle to one another to define an inner corner that fits over a respective outer corner of a fastener. The gripping pieces are displaceable along the plates into working positions reaching further into the jaw space. A force member is slidable along the plates to force the gripping pieces into the working position, in which the working faces frictionally engage peripheral faces of the fastener. A handle coupled to the head is pivotally movable in opposing directions to push and release the force member, thereby controlling engagement and release of the gripping pieces with the fastener.

9 Claims, 2 Drawing Sheets

P1
A2
A1
10
12
16
18
18a
20
22
26
28
30
32
34
36
38
40
42
44
46
48
50
52
52'
54
56
58
62
62a
62b
64
64a
64b
66
68
70
72
D
R
N

OPEN ENDED SOCKET WRENCH

CROSS REFERENCE TO RELATED APPLICATIONS

This application claims benefit under 35 U.S.C. 119(e) of Provisional Application Ser. No. 61/838,429, filed Jun. 24, 2012, the entirety of which is incorporated herein by reference.

FIELD OF THE INVENTION

The present invention relates generally to the field of hand tools, and more particularly to open ended socket wrenches.

BACKGROUND OF THE INVENTION

There have been numerous open ended socket wrench designs in the prior art, including those disclosed in U.S. Pat. Nos. 3,695,125, 4,204,440, 4,441,387, 4,562,757, 4,604,919, 5,249,487, 5,287,777, 5,454,283, 5,533,428, 5,553,520, 5,582,083, 6,158,309, 7,024,971, 7,188,550 and 7,249,539, and U.S. Patent Application Publication Numbers 2007/0044593 and 2011/0209583

However, Applicant has developed a new open ended socket wrench of unique design not seen heretofore.

SUMMARY OF THE INVENTION

According to a first aspect of the invention there is provided an open ended ratchet wrench comprising:

a wrench head comprising a pair outer face plates spaced apart from, and facing toward, one another and defining opposing faces of said wrench head, the outer plates having respective voids overlying one another and extending into the outer plates from matching ends of the outer plates so that boundaries of the voids delimit sides of a jaw space of the wrench head that is open at said matching ends of the outer plates;

a set of gripping pieces carried between the pair of outer face plates and comprising a pair of opposing gripping pieces that face toward one another from opposing sides of the jaw space, each gripping piece comprising a working side that faces into the jaw space and comprises two working faces that lie at an oblique angle to one another on opposite sides of an inner corner of the gripping piece for fitting of the inner corner of the gripping piece over a respective outer corner of a fastener so that the two working faces lie along respective peripheral faces of the fastener, and each gripping piece being movably carried between the pair of outer face plates for displacement along the plates between a release position and a working position in which the working side of the gripping piece is disposed further into the jaw space than in the release position;

a force member slidably disposed between the outer face plates for movement between a withdrawn position and an extended position, and arranged such that movement of the force member from the withdrawn position to the extended position forces the gripping pieces into the working positions from a driving side of the gripping pieces that lies opposite the working side thereof in order to force the gripping pieces into frictional contact with the peripheral faces of the fastener; and a handle pivotally coupled to the wrench head and having an elongated shape projecting from the wrench head, the handle being pivotal in a driving direction about a handle-pivot axis passing through the outer face plates of the wrench head to push the force member into the extended position, and also being pivotal about the handle-pivot axis in an opposing release direction to back the handle off from the force member.

Preferably the set of gripping pieces further comprises a pair of intermediate gripping pieces supported adjacent one another between the opposing gripping pieces at closed end of the jaw opposite the open end thereof.

Preferably the handle is spring biased into a neutral position about the handle-pivot axis.

Preferably each gripping piece is constrained to displacement along a predetermined path in movement between the working and release positions.

Preferably each gripping piece comprises a pin that projects therefrom into a respective slot in at least one of the outer face plates to constrain the displacement of the gripping piece to movement along a lengthwise path of said slot.

Preferably the lengthwise paths of the respective slots for the opposing gripping pieces lie on intersecting axes that converge toward the open end of the jaw space.

Preferably the force member is captured within an internal space between the outer face plates in a free floating condition within said internal space.

Surfaces of the force member facing the jaw space from the opposing sides thereof preferably slope outwardly away from the jaw space toward the respective ends of the outer face plates into which the voids extend

BRIEF DESCRIPTION OF THE DRAWINGS

In the accompanying drawings, which illustrate an exemplary embodiment of the present invention.

DETAILED DESCRIPTION

Figures 1, 2, 3, 4, 5, 6:
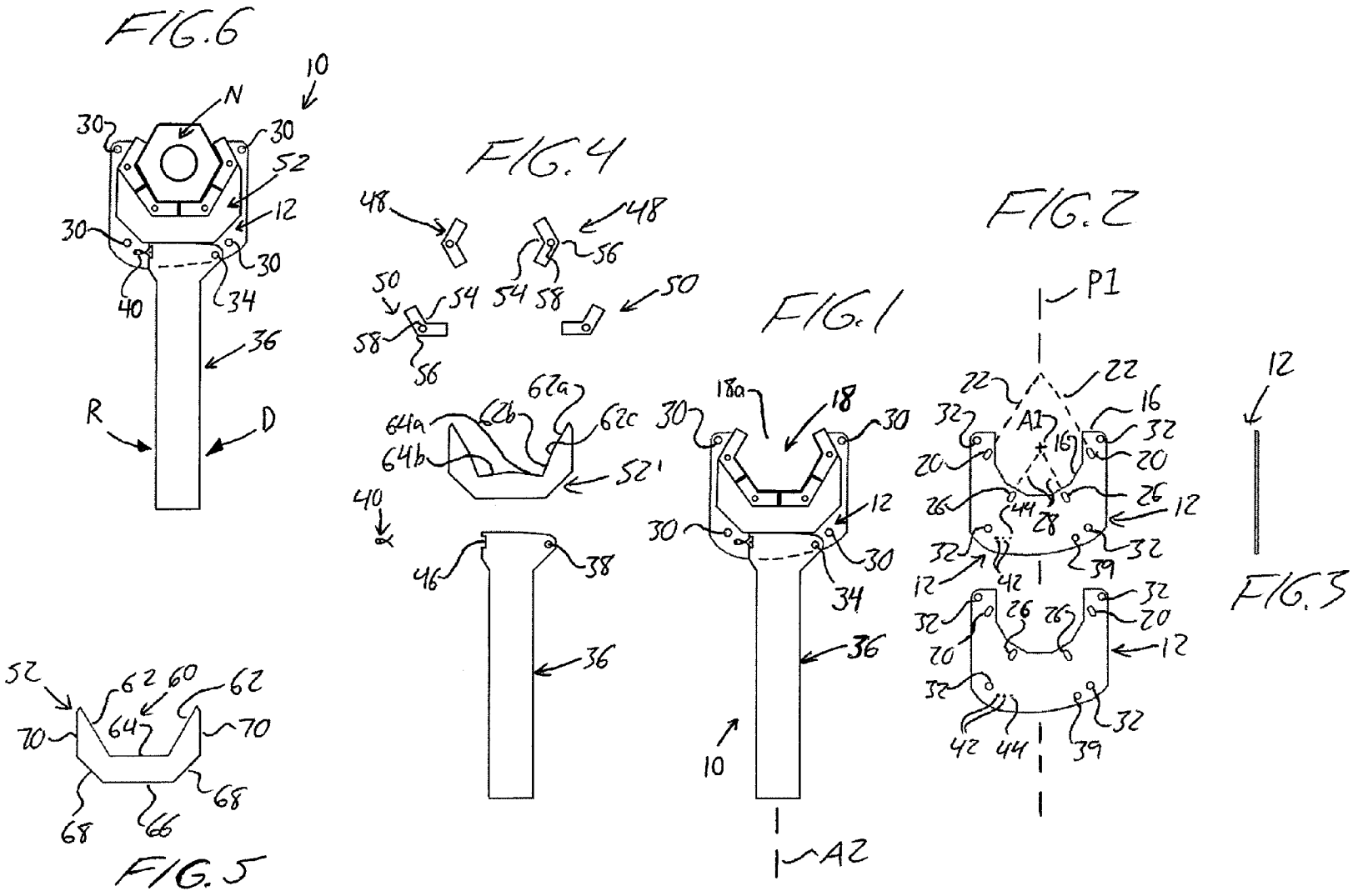
FIG. 1 is a schematic overhead plan view of an open ended ratchet wrench according to one embodiment of the present invention, with one of two faceplates of the wrench head shown in transparency in order to reveal internal components thereof.
FIG. 2 is a schematic overhead plan view of two disassembled faceplates of the open ended ratchet wrench of FIG. 1.
FIG. 3 is a side view of one of the faceplates of FIG. 2.
FIG. 4 is a schematic overhead plan view of a handle, handle-biasing spring, force application plate and gripping members of the open ended wrench of FIG. 1 in a disassembled state.
FIG. 5 is an isolated plan view of an alternate force application plate having a slightly modified shape compared to that of FIG. 4.
FIG. 6 is a schematic overhead plan view of the open ended ratchet wrench of FIG. 1 in use while gripping a nut.

The appended drawings schematically illustrate an open-ended ratchet wrench 10 according to one particular embodiment of the present invention. A head of the wrench features the two outer faceplates 12 that are identical to one another, and stacked one over the other in alignment so that they match as viewed from above. Each faceplate 12 features a generally U-shaped cutout 14 to form a U-shaped void extending into the plate from one end 16 thereof. The aligned cutout or voids 14 of the two faceplates 12 form a jaw space that extends through the two plates 12 on an axis A1 that is perpendicular to the plates. This axis A1 forms a rotational axis of the tool, around which the tool is rotated to drive rotation of a bolt head or nut. The jaw space 18 features an open end 18*a* at the ends of the plates 16 into which the cutouts 14 extend.

Just outside the boundary of the respective cutout 14, each faceplate 12 features a first pair of slots 20 defined in jaw-portions 20 of the plate that remain on opposing sides of a the U-shaped void or cutout 14. The first pair of slots 20 are symmetrical about a central longitudinal plane P1 of the tool that bisects the U-shaped cutout through its open end 18*a*, is perpendicular to the planes of the two parallel faceplates 12 and denotes a longitudinal direction of the tool. The first pair of slots 20 are of linear, elongated shape, with their lengthwise axes 22 converging in a direction moving toward the cutout end 16 of the plate and intersecting with one another at a point outside the perimeter of the plate beyond this end 16 thereof in the longitudinal plane P1.

Just outside the boundary of the respective cutout 14 at the closed end thereof, each faceplate 12 features a second pair of slots 26 that are also of linear elongated shape with intersecting axes 28 converging toward the cutout end 16 of the plate, and that are also symmetric about longitudinal plane P1. However, instead of converging at a location beyond the cutout end 16 of the plate, the axes 28 of the second pair of slots intersect at the rotational axis A1 of the tool in the central longitudinal plane P1. The first pair of slots 20 lie diametrically opposite one another relative to rotational axis A1, the second pair of slots 26 are each spaced 60-degrees around the rotational axis A1 from the respective one of the first slots 20 on the same side of the plane P1, and are also spaced 60-degrees around the rotational axis A1 from each other. The two pairs of slots 20, 26 are thus located on four vertices of a regularly-hexagonal path around the rotational axis A1.

The two faceplates 12 are connected to one another in a spaced apart condition along the rotational axis A1, for example by four pins or bolts 30 that are engaged through four respective holes 32 in each plate 12. These holes 32 are located near four corners of the plate's outer periphery so as to form two diagonally opposing pairs of such holes 32. Spacers are used with the pins or bolts 30 to maintain a predetermined spacing between the faceplates 12 by closing around the pins or bolts in the space between the faceplates, thereby keeping the two faceplates at the proper distance.

A fifth pin 34, for example consisting of high-quality steel, is used to define a handle offset pin to pivotally support a long handle 36 with an offset hole 38. This offset pin 34 is located near a respective one the four corner pins 30 at the end of the wrench head opposite the open end 18*a* of the jaw space 18. The handle 36 lies in a plane parallel to the faceplates 12 and normal to the rotational axis A1, with a central longitudinal axis A2 of the handle 36 normally lying in the central longitudinal plane P1. The offset hole 38 of the handle 36 is set off to one side of the handle's longitudinal axis A2, and receives the offset handle pin 34 via a matching offset hole 39 in each of the two faceplates 12. The offset pin 34 for the handle does not need necessarily need to move on the outer plating 12, as it may be arranged to move in the handle. Alternatively the offset handle pin 34 can fixed in the handle and move rotationally in the outer plating 12 of the wrench head. The handle is thus pivotally connected to the faceplates 12 for rotation relative thereto about the axis of the offset pin 34, which lies parallel to the rotational axis A1 of the tool.

A torsion spring 40 normally biases the handle 36 into a neutral position placing the handle axis A2 in the central longitudinal plane P1 of the tool. The coil portion of the torsion spring 40 closes around a pair of positioning pins that project perpendicularly between the faceplates 12 inside a pair of corresponding holes 42 located near the other one of the four corner pins 30 at the end of the wrench head opposite the open end 18*a* of the jaw space 18. Another spring-related pin 44 lies parallel to the two spring positioning pins 42 in order to extend perpendicularly between the two faceplates 12 at a corresponding spring-related pin hole 45 therein so that this pin is positioned between the flanges or free ends of the torsion spring. This pin 44 thus limits the amount of movement of either flange of the pin in a respective direction around the positioning pins 42. A cavity 46 is recessed into a longitudinal side edge of the handle 36 near the end thereof nearest the jaw space 18 so as to receive the third spring-related pin 44 and the two flanges of the torsion spring 40 within the cavity 46 at a position across the across the handle axis A2 from the offset pin 34 on which the handle 36 pivots. The third spring-related pin 44 prevents the handle from going too far in either direction.

In addition to the moving handle 36 and associated spring 40, the moving parts of the wrench also include four gripping units 48, 50 and one force transfer plate 52. The gripping units 48, 50 are identical to one another, and lie between the two faceplates 12 in an intermediate plane parallel thereto. Each gripping unit comprises a separate piece, which in the intermediate plane has the form of a shallow V-shape with a pair of linearly extending legs diverging from one another at approximately 120-degrees. Each piece 48 has an inside corner 54 measuring approximately 120-degrees, and an opposing outside corner 56 measuring approximately 240-degrees. Each gripping piece 48 may be cut from metal plate material so as to have opposing flat faces for riding along the flat inner faces of the faceplates 12.

Each gripping unit features a mounting pin 58 extending through the piece 48 on an axis perpendicular to the intermediate plane at an intermediate location between the inside and outside corners 54, 56 of the gripping unit. The mounting pin 58 of each gripping unit 48, 50 extends into a respective one of the slots 20, 26 in each of the two faceplates 12, whereby each gripping unit 48 is slidable back and forth along the elongated dimension of a respective pair of these slots in the two faceplates 12. Accordingly, two of the gripping units 48 are respectively engaged with the first pair of slots 20 in each faceplate to define a pair of opposing gripping units 48 disposed substantially across the jaw space 18 from one another near the open end 18a of the jaw space, while the two remaining gripping units 50 define an adjacent pair of intermediate gripping units disposed at the closed end of the jaw space 18 between the two opposing gripping units 48. In addition to guiding sliding motion of the gripping unit along the two respective slots, the mounting pin 58 of each gripping unit defines a gripper pivot axis that is parallel to the handle-pivot axis and in a same plane as the inner corner of the gripping piece. Each gripper unit can pivot about this respective gripper pivot axis.

The side of each gripping unit that defines the inner corner thereof faces into the jaw space 18 toward the rotational axis A1 passing perpendicularly therethrough so as to define a working side of the gripping unit that will engage a nut or bolt-head during use of the wrench. Two working faces on this working side of each gripping unit diverge obliquely from the inner corner of the unit, such that during use of the tool, these working faces run along two adjacent peripheral sides of a bolt head or nut when the inner corner is aligned with a respective corner of the bolt head or nut.

The opposing outer side of the gripping unit that features the outside corner of the piece defines a driving side of the gripping unit that faces outward from the jaw space 18 for contact thereof by the force member 52 during use of the wrench, as described below. The outer side of the nut features two driving faces that lie respectively parallel to the working faces of the opposing inner side.

The force member 52 is a generally U-shaped piece of plate that resides between the two faceplates 12 in the same intermediate plane as the gripping units 48, 50, with the open end of its U-shape facing toward both the jaw space 18 and the gripping units residing along the boundaries of the jaw space. The force member 52 is in a free-floating condition in the intermediate plane between the faceplates 12, in that it is freely slidable in any direction in this plane, within the constraints provided by the gripping pieces and the two of the corner pins 30 that join the two plates together at the handle-adjacent ends of the faceplates 12 opposite the open end 18*a* of the jaw space. These constraints prevent sliding of the force member 52 entirely out from between the faceplates 12.

With reference to FIG. 5, the force transfer plate 52 has the open interior 60 of its generally U-shape configured with obliquely oriented sides 62 that symmetrically converge moving into the U-shape of the plate from its open end, and a closed end 64 that joins these obliquely oriented sides together at their inner ends at equal angles. In FIG. 5, the open interior of the force transfer plate 52 is trapezoidal, whereby the two converging sides 62 and the closed end 64 are each entirely flat or linear from one end to the other. A modified form of the force transfer plate 52' is shown in FIG. 4, where the converging sides 62' of the force transfer plate each have two flat or linear segments 62*a*, 62*b* that join together at a small peak or apex 62*c* at a central point on the overall length of the side or end. The closed end of the opening interior 64 also has this peaked arrangement featuring two segments 64*a*, 64 at a slight angle to one another.

The outside of the transfer plate's U-shape features a flat end 66 lying opposite the open end of its U-shape, angled transitions or bevels 68 that symmetrically angle obliquely outward and toward the open end of the transfer plate 52 from the flat end 66, and flat sides 70 that extend from the bevels 68 toward the open end of the plate on opposite sides of the open interior 60 of the plate in directions perpendicular to the flat end 66.

With reference to FIG. 1, the length of the flat end 66 is less than the straight-line distance between the two pins 30 that connect the faceplates 12 together at the handle-adjacent end of the wrench head opposite the open end 18a of the jaw space 18. However, the width of the transfer plate 52 between the flat outer sides 70 thereof exceeds this distance between the two pins 30 at the handle end of the wrench head. Accordingly, the transfer plate 52 is captured between these two pins 30 and the set of four gripper units 48 that lie along the boundaries of the jaw space, but is slidable and forth between the pins and the grippers 48. Particularly, the transfer plate is slidable between a withdrawn or retracted position in which the transfer plate 52 is withdrawn away from the jaw space in the longitudinal direction to a point placing the beveled end portions 68 in abutment against the pins 30 at the handle-adjacent end of the wrench head, and an extended position in which the transfer plate is extended toward the jaw space in the longitudinal direction out of contact with the pins 30 at the handle-adjacent end of the wrench head and abutted against the gripper units 48, 50 in a position having pushed the gripper units into working positions at the end of their respective faceplate slots nearest the jaw space.

As shown in FIG. 1, with the transfer plate 52 extended and the gripping units in their working positions, the four gripping units 48, 50 lie on a regular-hexagonal path around the rotational axis A1 of the tool, whereby with a hexagonal bolt-head or nut centered on the rotational axis A1 to lie substantially within the jaw space 18, the inner corners of the gripping units 48, 50 point radially toward the rotational axis A1 at the center of the nut or bolt head at a respective one of the six corners of the hexagonal path.

The length of each angled inner side 62 of the transfer plate 52 spans twice the distance of one of the gripper unit legs, whereby with the transfer plate extended, each angled inner side 62 of the transfer plate 52 spans from the outer corner of one of the intermediate gripper units 50 to the outer corner of one of the opposing gripper units on a respective side of the jaw space. The length of the closed end 64 is also twice the leg-length of the gripper members, so that it spans from the outer corner of one of the intermediate gripping units to the outer corner of the other intermediate gripping unit.

The force transfer plate, when in the extended position, holds the gripper members in their working positions fully extended along their respective faceplate slots 26, 20 so as to reach further into the jaw space than when the transfer plate 52 is retracted. Retraction of the transfer plate 52 allows the gripping members 48, 50 to back away from the jaw space 18 along their slots 20, 26.

Referring to FIG. 6, with the head of the wrench having been placed over a nut N so to position the majority of the nut in the jaw space with four peripheral corners of the nut generally pointing to the inner corners of the gripping units 48, 50, rotating the handle 36 in a driving direction D around the axis of the offset pin 34 near one of the corners of the head-end of the handle 36 nearest the jaw space acts to move the opposing corner of this head-end of the handle 36 toward the jaw-space 18. Accordingly, this portion of the handle pushes against the flat end 66 of the force transfer plate 52 in a direction toward the jaw space 18, thus pushing the force transfer plate 52 from the withdrawn position toward the extended position, which in turn forces the gripping units 48, 50 toward their working positions. This acts to clamp each gripping unit against the periphery of the nut in a conforming manner at a respective corner thereof, thus gripping the aforementioned four corners of the nut within the four gripping members. Continued forcing of the tool handle in the driving direction D ceases to rotate the handle relative to the faceplates due to the abutment between the tool handle, the force transfer plate, the gripping members, and the nut. Instead this continued forcing of the handle in the driving direction D rotates the entire tool, and thus also rotates the gripped nut, around the rotational axis A1.

After driving the rotation of the nut through a desired angular range in direction D, the handle is then pulled back in an opposing release direction R around the axis of the offset pin 34, or the force on the handle is released to allow such movement in the reverse direction R automatically under the action of the spring. This rotation in direction R pulls the head-end of the handle 36 out of its abutment against the flat end 66 of the force transfer plate 52, and thus releases the force that was previously pushing the force transfer plate toward the open end 18*a* of the wrench head and tightening the gripping members on the nut.

Figure 7A:
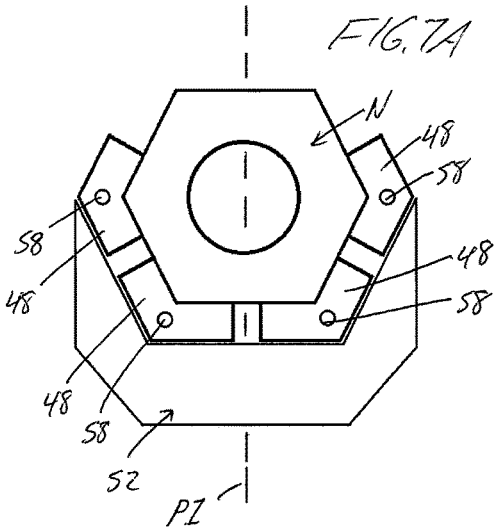
FIGS. 7A through 7D schematically illustrate sequential stages of a release stroke of the wrench in which the nut is released from the gripped state shown in FIG. 6 to enable rotation of the wrench around the nut and into another gripping position at another side thereof, as shown by the final stage of the release stroke in FIG. 7D.
Figure 7B:
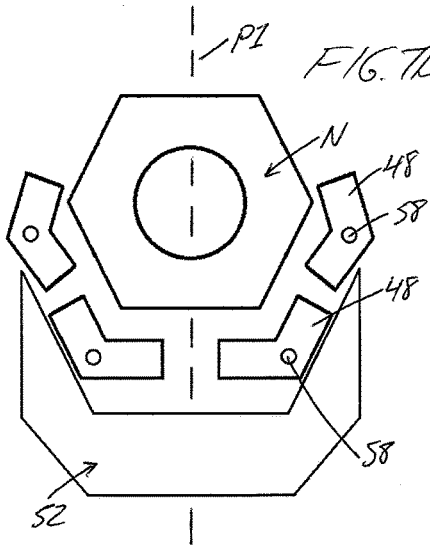
Figure 7C:
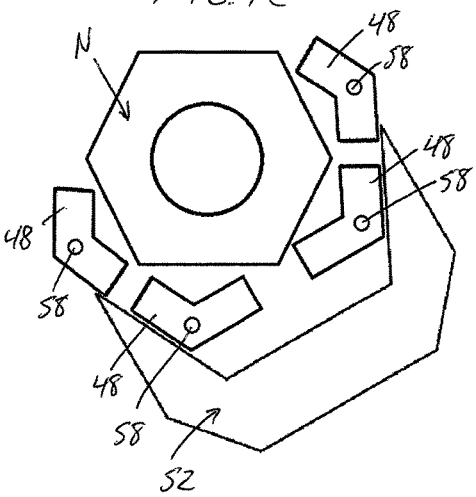
Figure 7D:
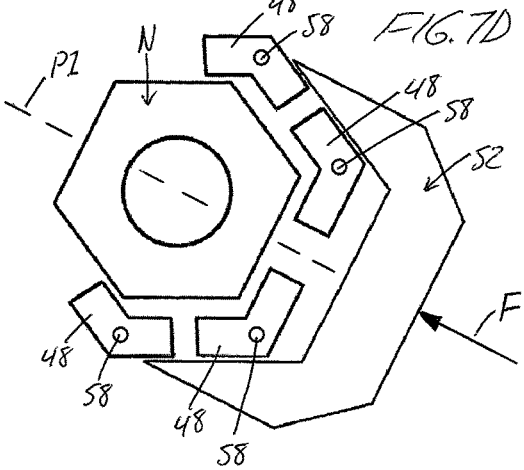

Accordingly, with this force withdrawn, and the handle pivoted out of abutment with the force transfer plate 52, continued pivoting of the handle in this release direction R through the neutral position, and subsequently against the bias of the spring 40, attempts to rotate the entire tool around the nut R. FIG. 7A shows the gripping units 48 still in their working positions contacting the periphery of the nut due to the extended position of the force transfer plate 52 as rotation of the wrench in the reverse direction R is initiated. A resistance to this rotation by the nut forces the gripping members 48, 50 out of their working positions in a direction outwardly away from the jaw space 18, and into retracted positions shown in FIG. 7B. This outward movement of the gripping units pushes the force transfer plate 52 outward to its withdrawn position, as also shown in FIG. 7B. The outward displacement of the gripping units opens up a large enough gap between each gripping member and the nut periphery to allow this continued rotation of the tool to swivel the tool around the nut, whereby each gripping unit can be slipped circumferentially around the nut from the corner of the nut to which it was engaged during the previous drive stroke of the wrench to, or past, the next corner around the periphery of the nut, as shown in FIGS. 7C and 7D.

Figure 7E:
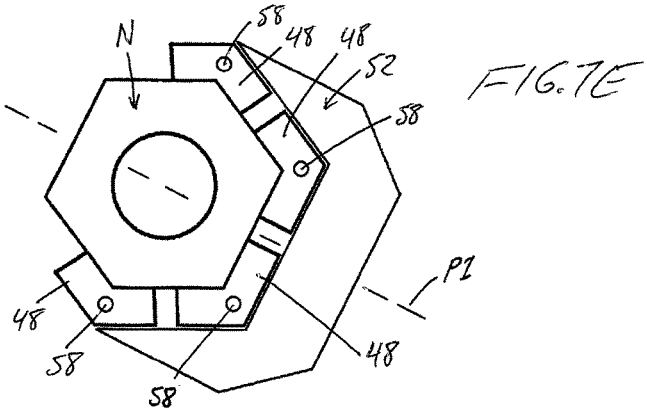
FIG. 7E shows initiation of a drive stroke of the wrench after the final release stage of FIG. 7D.

Having performed such a stroke of the handle 36 in direction R to release the grip of the wrench and the slip the same around the nut in a direction opposing the desired drive direction D of the nut, a next drive stroke of the wrench handle in direction D can be performed in order to repeat another driving action on the nut in the desired direction of rotation. FIG. 7D shows the end stage of the release stroke, where the jaw space has arrived at a new side of the nut. Here, the next drive stroke is initiated by pivoting the handle in the drive direction D, which slides the force transfer plate 52 toward the jaw space and back into its extended position, as schematically illustrated by force arrow F. As shown in FIG. 7E, this extension of the of the force transfer plate 52 forces the gripper units 48 back into their working positions engaging the corners of the nut so that rotation of the wrench in drive direction D will turn the nut N. Repeated and alternating drive and release/slip strokes in opposing directions thus performs a ratcheting action on the nut.

The drawings show the wrench in an orientation that places the point of contact between the handle and the force transfer plate at a position located clockwise around the rotational axis A1 from the offset pin 34 of the handle 36. Accordingly, in the drawings, the drive direction D is clockwise around the rotational axis A1 so as to perform a tightening of the nut during the drive stroke. Simply by flipping the wrench over in order to reverse the directions that are faced by the faceplates along the rotational axis A1 of the bolt, the drive direction becomes counterclockwise, whereby the tool is useful to loosen the nut from the bolt.

In summary of the illustrated embodiment, two identical plates 12 form the outside faces of the wrench. There are four nonmoving pins, with spacers, that connect the two faceplates 12 together. Three small nonmoving pins are used to center the spring, which connects with the handle to assistance in centering thereof, and the handle displaces the force transfer plate, which in turn displaces the gripper units into their working or gripping position. The gripper units are designed so they match the surface of the hexagonal nut, when gripping, and the force transfer plate is matched to the outside of the gripper units when they are at maximum grip. As for the offset in the handle, it is offset in such a way that it allows the force transfer plate enough room to move, so that it may allow the grippers sufficient space to release, or allow a nut to rotate.

The offset converts torque on the handle into the force transfer plate, and from there, the force is transferred to the four gripping parts. Thus, the harder one pulls on the handle, the harder the nut is gripped. Two outer faceplates provide a guide track for the gripping parts to follow, when under force from the transfer plate. The spring is used to normally center the handle, so that is neither in a tight grip, nor too loose. As an alternative, instead of performing a centering action moving the handle to a neutral location, a spring biasing mechanism may be arranged to force the wrench out of the gripping condition, by forcing the handle to a point having no influence on the force transfer plate.

As for the four gripping parts, the top two opposing grippers (or outer ones) located nearest the open end of the jaw space provide the primary gripping action on the nut or bolt head by clamping the same from diametrically opposing points. However, the two bottom or intermediate ones are included as a guide, and assist in preventing the nut from slipping. When force is applied to the handle, the force transfer plate pushes the top two grippers up and into position. The two bottom grippers are pushed up on an angle towards the center of the nut. Each gripper then grabs a corner of the nut, whereby four of the six corners are grabbed.

As the handle moves back (i.e. in the release direction R), tension is removed from the force transfer plate. This allows the nut to assert force on the grippers, which in turn pushes back the force transfer plate, and all grippers move away from the nut slightly. This is enough to allow it to slip. And once the handle-forcing direction is reversed again (i.e. into drive direction D), force is once more transferred through the transfer plate to the grippers. The nut will slip into the proper grooves at the inner corners of the grippers, and the force for moving the handle will be transferred into turning the nut. This will allow anyone to work on a nut, without having to take off the wrench. Thus, the device can ratchet upon a nut, as a grippers alternatingly grab and glide during the two opposing handle strokes.

To release the ratchet from a nut, one simply needs to pull back with a slight twist of the wrist in the release direction R, i.e. counterclockwise in the drawings. This will move the handle far enough away from the tension plate, that the force of the nut will move the grippers out-of-the-way. The wrench make a slight clicking sound as it clicks off. To attach wrench to a nut, one simply needs to repeat the same action as for taking it off, with the exception of pushing it onto the nut through the open end of the jaws. Under this action of forcing the wrench radially onto a bolt head or nut, the two opposing grippers adjacent the open end will pivot about their respective mounting pin axes to accommodate relative movement of the bolt head or nut into the jaw space between these two opposing grippers Other embodiments need not necessarily allow pivoting of the grippers, and for example rely solely on the sliding displacement of the grippers along their respective slots to create a large enough opening between the opposing pair of grippers to accommodate the bolt head or nut, but use of round gripper pins in the slots to allow pivoting of the grippers about their pin axes, at least for the two opposing grippers, reduces the required amount of sliding needed to create such space for accommodating entry of the bolt head or nut, thus minimizing the required overall size of the wrench head needed to accommodate the slot length. This keeps the tool size and weight to a minimum. During use, a slight clock wise twist to the wrist as one applies tension to a nut, assists the wrench, allowing for speedier operation. A slight counter-clockwise twist, will make the wrench easier to remove from a nut.

Regarding environmental conditions, due to the fact that the wrench will not always be used within ideal conditions, the grippers may include a slight gap between each of them. This will provide an allowance for dirt, fine gravel or other particular or debris to minimize the chance of stopping or interfering with the gripping process. The force transfer plate may use a series of indents so that it pushes upon the grippers at angles. This will force dirt to move and not interfere with the grippers, as it would with perfect flush contact between these parts.

One example of such 'indentation' or other debris-accommodating configuration of the transfer plate is shown in the 'peaked' version of the transfer plate of FIG. 4, where the peaks at the center of the sides and end of the open interior each reside between a neighbouring pair of the grippers, and the oblique angling of the diverging segments of the side or end provide clearance between the transfer plate and the respective gripper. The slope of the outer segments 62*a* of the sides 62 that reside at the open end of the interior space match the slope of the entirely linear sides of the trapezoidal-opening version of the transfer plate in FIG. 5, whereby the these segments 62*a* abut purely flush against the respective legs of the two opposing grippers when in the gripping or working position, thereby ensuring that these two grippers that diametrically grip the nut between them are fully and properly forced into their gripping or working positions. Other shaping or surface configurations of the transfer plate may be employed in a manner providing suitable clearance for debris while still conforming against the outer or driving sides of the opposing pair of grippers.

In addition, if the moving parts were to be coated in a substance like Teflon, this would allow the wrench smooth operation, not only in normal atmospheric conditions, but also in other environments such as in space and underwater. In the vacuum of space, grease lubricant beads, and under water, grease lubricant washes away. In such environments, where bulky and cumbersome body-worn equipment makes use of tools challenging due to difficulties in being able to accurately place a tool in relation to the fastener being worked, the easy snap-on action of the present open-jawed ratchet wrench may provide particularly valuable.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. An open ended ratchet wrench comprising:

a wrench head comprising a pair outer face plates spaced apart from, and facing toward, one another and defining opposing faces of said wrench head, the outer plates having respective voids overlying one another and extending into the outer plates from matching ends of the outer plates so that boundaries of the voids delimit sides of a jaw space that has an open end at said matching ends of the outer plates;

a set of gripping pieces carried between the pair of outer face plates and comprising a pair of opposing gripping pieces that face toward one another from opposing sides of the jaw space, each gripping piece comprising a working side that faces into the jaw space and comprises two working faces that lie at an oblique angle to one another on opposite sides of an inner corner of the gripping piece for fitting of the inner corner of the gripping piece over a respective outer corner of a fastener so that the two working faces lie along respective peripheral faces of the fastener, and each gripping piece being movably carried between the pair of outer face plates for displacement relative to the plates between a release position and a working position in which the working side of the gripping piece is disposed further into the jaw space than in the release position;

a force member slidably that is disposed between the outer face plates, is movable relative thereto between withdrawn and extended positions that are spaced apart in a longitudinal direction denoted by a longitudinal plane that bisects the jaw space through the open end thereof, and is arranged such that movement of the force member from the withdrawn position to the extended position forces the gripping pieces into the working positions from driving sides of the gripping pieces that lie opposite the working sides thereof in order to force the gripping pieces into frictional contact with the peripheral faces of the fastener, the force member having an open interior that opens toward the jaw space and features converging sides that are joined together by a closed end of the open interior and are positioned on opposing sides of the longitudinal plane at the opposing sides of the jaw space to respectively act against the pair of opposing gripping pieces at the driving sides thereof; and a handle pivotally coupled to the wrench head and having an elongated shape projecting from the wrench head, the handle being pivotal in a driving direction about a handle-pivot axis passing through the outer face plates of the wrench head to push the force member into the extended position, and also being pivotal about the handle-pivot axis in an opposing release direction to back the handle off from the force member.

2. The open ended ratchet wrench of claim 1 wherein the set of gripping pieces further comprises a pair of intermediate gripping pieces supported adjacent one another between the opposing gripping pieces at closed end of the jaw opposite the open end thereof.

3. The open ended ratchet wrench of claim 1 wherein the handle is spring biased into a neutral position about the handle-pivot axis.

4. The open ended ratchet wrench of claim 1 wherein each gripping piece is constrained to displacement along a predetermined path in movement between the working and release positions.

5. The open ended ratchet wrench of claim 4 wherein each gripping piece comprises a pin that projects therefrom into a respective slot in at least one of the outer face plates to constrain the displacement of the gripping piece to movement along a lengthwise path of said slot.

6. The open ended ratchet wrench of claim 5 wherein the lengthwise paths of the respective slots for the opposing gripping pieces lie on intersecting axes that converge toward the open end of the jaw space.

7. The open ended ratchet wrench of claim 1 wherein the force member is captured within an internal space between the outer face plates in a free floating condition within said internal space.

8. The open ended ratchet wrench of claim 1 wherein surfaces of the force member facing the jaw space from the opposing sides thereof slope outwardly away from the jaw space toward the respective ends of the outer face plates into which the voids extend.

9. The open ended ratchet wrench of claim 1 wherein each gripping piece is pivotal about a gripper-pivot axis that is parallel to the handle-pivot axis and is in a same plane as the inner corner of the gripping piece.

* * * * *